US006150906A

United States Patent [19]

Lee et al.

[11] Patent Number: 6,150,906

[45] Date of Patent: Nov. 21, 2000

[54] HF FILTER USING RESONATORS HAVING CONVEX-CONCAVE STRUCTURE

[75] Inventors: Chang Hwa Lee; Bon Hee Koo; Oh Gon Chun; Sang Seok Lee, all of Taejon, Rep. of Korea

[73] Assignee: Electronics and Telecommunications Research Institute, Taejon, Rep. of Korea

[21] Appl. No.: 09/211,561

[22] Filed: Dec. 15, 1998

[30] Foreign Application Priority Data

Aug. 25, 1998 [KR] Rep. of Korea ..... 98-34468

[51] Int. Cl.[7] ..... H01P 1/20; H01P 7/04

[52] U.S. Cl. ..... 333/206; 333/202; 333/222

[58] Field of Search ..... 333/202, 206, 333/204, 222, 203

[56] References Cited

U.S. PATENT DOCUMENTS

| | | | |
|---|---|---|---|
| 4,733,208 | 3/1988 | Ishikawa et al. . | |
| 5,160,905 | 11/1992 | Hoang | 333/203 |
| 5,208,565 | 5/1993 | Sogo et al. . | |
| 5,396,201 | 3/1995 | Ishizaki et al. . | |
| 5,936,489 | 8/1999 | Lee at al. | 333/202 |

FOREIGN PATENT DOCUMENTS

| | | |
|---|---|---|
| 03234102 | 10/1991 | Japan . |
| 05347505 | 12/1993 | Japan . |
| 06125202 | 5/1994 | Japan . |

OTHER PUBLICATIONS

Matsumoto, Haruo et al., "A Miniaturized Dielectric Monoblock Band–Pass Filter For 800 MHz Band Cordless Telephone System"; 1994 IEEE MTT–S Digest, pp. 249–252.

Ishizaki, Toshio et al., "A Stepped Impedance Comb–Line Filter Fabricated By Using Ceramic Lamination Technique"; 1994 IEEE MTT–S Digest, pp. 617–620.

Ishizaki, Toshio et al., "A Very Small Dielectric Planar Filter For Portable Telephones"; IEEE Transactions On Microwave Theory and Techniques, vol. 42, No. 11, Nov. 11, 1994, pp. 2017–2022.

*Primary Examiner*—Robert Pascal
*Assistant Examiner*—Patricia T. Nguyen
*Attorney, Agent, or Firm*—Cohen, Pontani, Lieberman & Pavane

[57] ABSTRACT

An HF filter using resonators of a convex-concave structure is capable of easily inserting a serial or parallel capacitance inside the resonators for the sake of a characteristic improvement of frequency at a stop band desired. In the inventive HF filter, an error compensation is simple and a size smallization is available, by utilizing the resonators of the convex-concave structure. Such HF filter consists of a dielectric block having a multitude of grooves formed, in a length direction, on an upper face thereof; a plurality of resonators formed by covering a lowly constant portion of each groove with conductive material, for resonating signals inputted from the outside; a grounding electrode formed on an outer face of the dielectric block and electrically shorted with the PCB; an input electrode for receiving signals from the outside; an output electrode for outputting signals; and a first nonplating part for preventing the input and output electrodes from being electrically shorted with the grounding electrode and realizing a capacitive coupling among the input and output electrodes and its adjacent resonators, thereby being employed in a smallization of a radio communication system and an improvement of a communicative characteristic.

2 Claims, 9 Drawing Sheets

HF FILTER USING RESONATORS HAVING CONVEX-CONCAVE STRUCTURE

FIELD OF THE INVENTION

The present invention relates to a high frequency (HF) filter using a dielectric; and, more particularly, to an HF filter using resonators having a convex-concave structure, which is used in an HF circuit of an antenna next end, for use of such systems as a mobile radio communication, a personal communication, a satellite communication and a radio communication like an IMT-2000, and which is capable of passing signals of desired frequency and eliminating signals of frequency not desired.

DESCRIPTION OF THE PRIOR ART

In general, it is frequently used a TEM (transverse electromagnetic mode) dielectric coaxial resonator as an HF filter used on a next end of an antenna in a radio communication system, at present. Though the number of the coaxial resonators used at this time is decided by a requirement characteristic of a filter, resonators more two are generally combined with each other in its manufacture process.

Recently, a smallization for an HF filter is getting required more and more according to a small-sized trend for terminal equipments of a communication system, and also, for the sake of an efficient usage of frequency, transmission and reception frequency bands are adjacent to each other in the radio communication system, that is, in a filter used in an HF circuit of such communication system, a prominent attenuation characteristic is required at a stop band corresponding to frequency higher or lower than frequency of a pass band, and the HF filter is further required for a smallization/lightenization in conformity to the small-sized and a lightening trend of the communication system. In addition, a compensation for a manufacture permissible error is required according as usage frequency becomes a high frequency trend.

With reference to FIGS. 1 and 2 showing the structure of an HF filter using a dielectric based on the conventional technology, FIG. 1 provides the structure of a filter incorporating three resonators, as a unitary structure, in which more two resonators are constructed in one dielectric block of the filter. Such filter consists of a dielectric block 1 of a rectangular shape covered with conductive metal and three resonators 2*a*, 2*b*, 2*c* formed perpendicularly inside the dielectric block 1. The resonators 2*a*, 2*b*, 2*c* have each of three through-holes with respective same size in a type that the resonators each pierce through upper and lower sides of the dielectric block 1, wherein each inner surface of the through-holes is sprinkled with conductive metal. Such resonators 2*a*, 2*b*, 2*c* operate as ¼ wavelength short resonators.

Each of decoupling holes 3 of a hollow shape is formed in a piercing type among the resonators 2*a*, 2*b*, 2*c*, to control a coupling amount between the upper side of the dielectric block 1 and the resonator, and inner surfaces of the decoupling holes 3 are not coated with the conductive metal.

Conductive rods 4*a*, 4*b* connected to input or output terminals are each inserted into the first and final resonators 2*a*, 2*c*of the dielectric block 1. A dielectric 5 is combined between each resonator 2*a*, 2*c* and each conductive rod 4*a*, 4*b*, to couple the resonator with the conductive rod.

Under such construction, a signal inputted to the input terminal is transferred to the resonator through a combination of electromagnetic field provided between the inner side of the decoupling hole 3 for use of the input terminal and the resonator 2*a*. This signal is transmitted from a prior resonator to a next resonator by using the combination of the electromagnetic field provided between the resonators. And then, the inputted signal is sent to an output decoupling hole via the electromagnetic field combination generated between the resonator and the decoupling hole for use of the output terminal, and consequently, energy is transferred from the input terminal to the output through the resonators 2*a*, 2*b*, 2*c*.

The coupling amount among the resonators is available to be controlled by a change of an opening size of the decoupling hole 3 which is for the sake of a control of the coupling amount, or by moving a position of the decoupling hole 3 to a front side or a back side of the dielectric block 1 through a use of a characteristic that the electromagnetic filed is getting strong at a central portion of the dielectric block 1 and getting weaker gradually towards the front side or the back side of the dielectric block 1.

In such filter, the decoupling hole 3 for controlling the coupling amount among the resonators 2*a*, 2*b*, 2*c* is formed in a hollow shape, to thus reduce the coupling amount by a difference of a dielectric constant with the dielectric block 1, whereby the smallization for the filters is available.

However, in the filter using the conventional dielectric resonators as the above-mentioned, there are limitations, in a control of the coupling amount based on an aperture size change of the decoupling hole or its positional movement, and in reducing height of the filter when the filter is mounted on the printed circuit board (PCB) through a decrease of a thickness of the dielectric block.

In disposing the conductive metal on the inner surface of the resonators, it further needs an additional process on the inner surface of the decoupling holes so as not to be covered with the conductive metal, for the sake of a control of the coupling amount, therefore a manufacture process of the filter is complicated. Furthermore, there is a difficulty in actually mounting the filter on the surface of the PCB since the conductive rods connected with the input and output terminals are projected from the upper surface of the filter.

Attenuation characteristics of such filter are same in frequency higher or lower than the pass band as shown in FIG. 8, but for improving the attenuation characteristic on the stop band, the number of the resonators must be increased, in other words, the insertion loss becomes much and a general size of the filter becomes large.

For a settlement of such conventional problem, a polarized filter is used in order to cut off a transfer of signals provided from specific frequency and to thereby improve the attenuation characteristic, by installing a chip capacitor or inductor on the outer surface, but this also causes a complication in the manufacture process as the chip elements are used on the outside thereof.

In another conventional technique shown in FIG. 2, a filter using a dielectric includes a dielectric block 6 coated with conductive metal on an outer surface thereof so as to form a grounding face 6*a*, and input and output electrodes 7 formed symmetrically with each other on an outer side of the dielectric block 6, so that it is available to equip the filter on the surface of the PCB by an electric cut-off between the input and output electrodes 7 and the grounding face 6*a*, and available in the smallization by not forming decoupling holes provided for a control of the coupling amount between the resonators. In the filter of FIG. 2, however, a limitation in accomplishing the smallization via a decrease of height thereof is also caused in equipping the filter on the PCB since the resonators are here embodied by piercing holes passed through the inside of the dielectric block. In order to improve the attenuation characteristic at the stop band, like the filter shown in FIG. 1, the number of the resonators must be increased, which further causes that the insertion loss becomes high and the size of the filter becomes increased.

SUMMARY OF THE INVENTION

It is, therefore, a primary object of the invention to provide an HF filter using resonators having a convex-concave structure, in which a serial or parallel capacitance can easily be inserted inside the resonator for the sake of a characteristic improvement of frequency at a stop band desired, an error compensation is simple, and a size smallization and a simplicity of a manufacture process are available to thus reduce a manufacture cost, in manufacturing filters used for HF circuits of a communication system through a use of a dielectric.

Another object of the present invention is to provide an HF filter using the resonators of convex-concave structure, which is capable of obtaining a smallization thereof by forming a convex-concave part in a dielectric block and covering with conductive metal on an edge side of a groove, in constructing the resonators, and especially capable of decreasing height of the filter to be thereby mounted on a PCB with high density.

A further object of the present invention is to provide an HF filter using the resonators of convex-concave structure, which is capable of lessening an influence from outer electromagnetic wave in actually mounting the inventive filter on the PCB since all outer electrodes except input and output electrodes are grounding electrodes.

An additional object of the present invention is to provide an HF filter using the resonators of convex-concave structure, which is capable of easily inserting a serial or parallel capacitance between the resonators, namely by using a dielectric face exposed between the resonators, for the sake of the characteristic improvement of frequency at the stop band desired.

In accordance with the present invention for achieving the above objects, an HF filter using the resonators of the convex-concave structure is composed of a dielectric block having a multitude of grooves formed, in a length direction, on an upper face thereof; a plurality of resonators formed by covering a lowly constant portion of each groove with conductive material, for resonating signals inputted from the outside; a grounding electrode formed by covering a given portion of an outer face of the dielectric block with the conductive material and electrically shorted with the PCB; an input electrode formed on a constant portion not plated on the dielectric block, for inputting signals from the outside; an output electrode formed on a constant portion not plated on the dielectric block, for outputting signals; and a first nonplating part formed on an adjacent portion of the input and output electrodes, for preventing the input and output electrodes from being electrically shorted with the grounding electrode and for realizing a capacitive coupling among the input and output electrodes and its adjacent resonators.

In accordance with the present invention, an HF filter using resonators of the convex-concave structure is further provided including a dielectric block having numerous grooves formed, in a length direction, on an upper face thereof; a plurality of resonators formed by covering a lowly constant portion of each groove with conductive material, for resonating signals inputted from the outside; a grounding electrode formed by covering a given portion of an outer face of the dielectric block with the conductive material and electrically shorted with the PCB; a projection part formed projected with the same height as the resonator, between the grooves of the dielectric block, wherein an upper face of the projection part is not plated with the conductive material so as to prevent the resonators and the grounding electrode from being electrically shorted; an electrode formed covered with the conductive material on a given portion of the upper face of the projection part, for generating a capacitive coupling among the resonators; an input electrode formed on a portion not plated on the dielectric block, for inputting signals from the outside; an output electrode formed on a portion not plated on the dielectric block, for outputting signals; and a fourth nonpiating part formed on an adjacent portion of the input and output electrodes, for preventing the input and output electrodes from being electrically shorted with the grounding electrode.

BRIEF DESCRIPTION OF THE DRAWINGS

The above and other objects and features of the instant invention will become apparent from the following description of preferred embodiments taken in conjunction with the accompanying drawings, in which.

DETAILED DESCRIPTION OF THE PREFERRED EMBODIMENTS

The preferred embodiments of the present invention are described in detail as follows, referring to the accompanying drawings.

Figure 1:
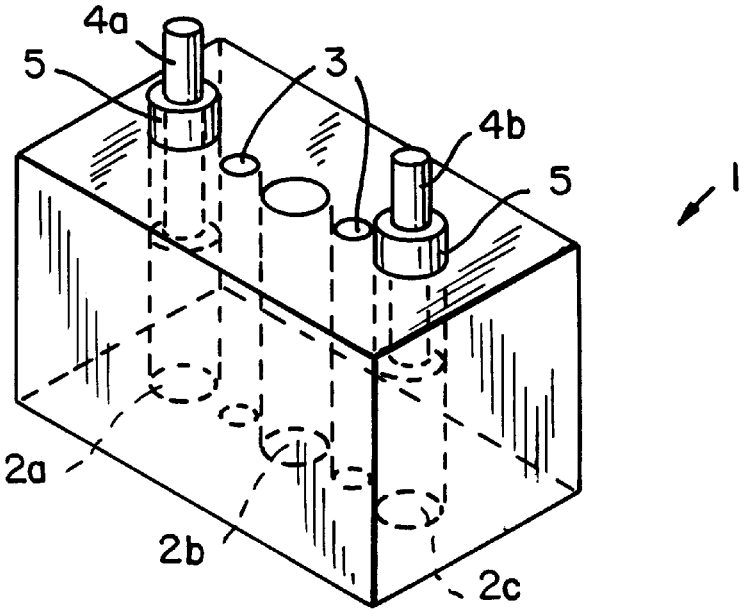
FIG. 1 (PRIOR ART)
FIG. 1 is a schematic perspective view showing one construction of a filter using a dielectric according to a conventional technique.
Figure 2:
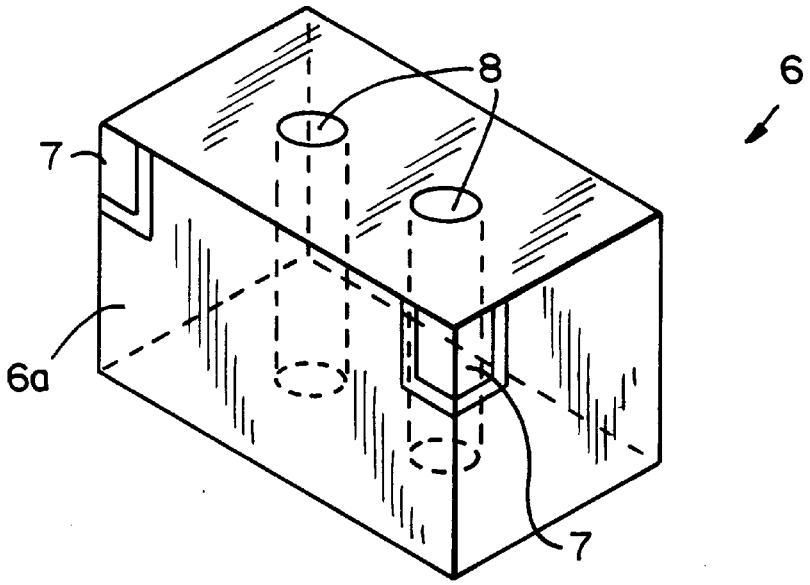
FIG. 2 (PRIOR ART)
FIG. 2 presents a schematic perspective view providing another construction of a filter using a dielectric based on the conventional technique.
Figure 3:
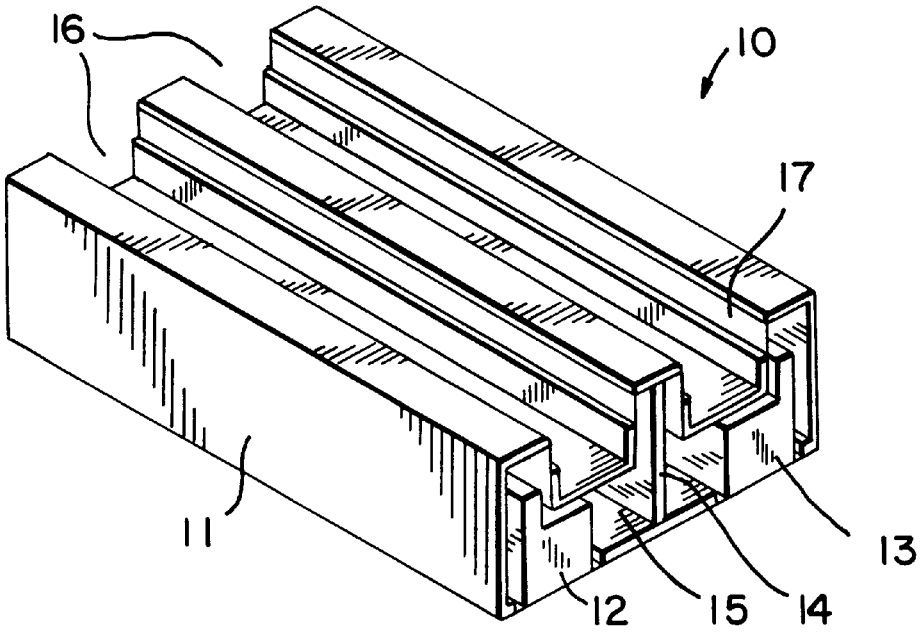
FIG. 3 sets forth a perspective view of a high frequency (HF) filter using resonators having a convexconcave structure in accordance with a first embodiment of the present invention.
Figure 4:
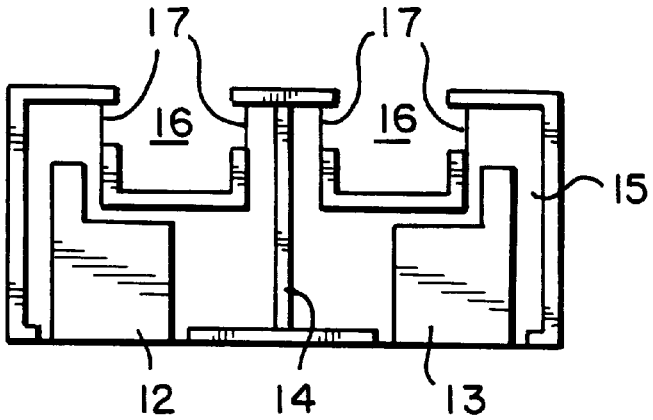
FIG. 4 indicates a side view of the HF filter shown in FIG. 3.
Figure 5:
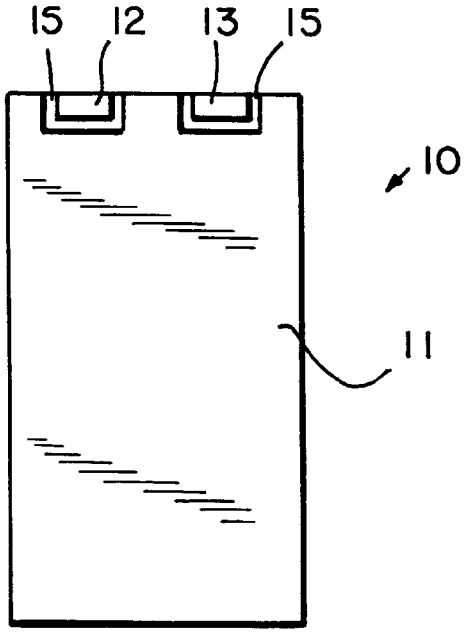
FIG. 5 shows a bottom view of the HF filter shown in FIG. 3.

In accordance with a first embodiment of the present invention referring to FIGS. 3 to 5, an HF filter equips a dielectric block 10 covered with conductive metal on a given outer surface thereof so as to serve as a grounding electrode 11.

The dielectric block 10 is constructed by input and output electrodes 12, 13 in charge of an input and an output of signals, respectively formed on a nonplated outer surface of one side thereof; another grounding electrode 14 formed between the input and output electrodes 12, 13, for connecting the grounding electrodes 11 set on upper and lower face of the dielectric block 10; and a nonplating part 15 formed on an adjacent portion of the input and output electrodes 12, 13, for preventing the input and output electrodes 12, 13 from being electrically shorted with the grounding electrodes 11, 14.

Figure 7:
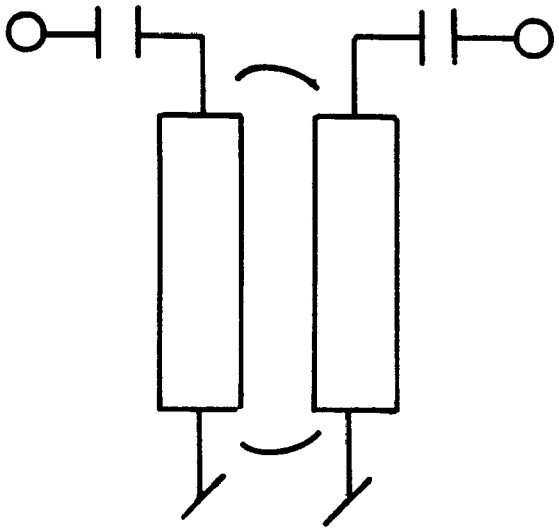
FIG. 7 represents an equivalent circuit diagram of the HF filter shown in FIGS. 2 and 3.

In an additional construction of the dielectric block 10, grooves having each flat inner surface are formed in a length direction on an upper face of the dielectric block 10, wherein a constant portion on each inner surface of the grooves is plated with conductive metal, so as to operate as resonators 16. A nonplating part 17 is also formed between the grounding electrodes 11, 14 and the resonators 16, to prevent the resonators 16 from being electrically shorted with the grounding electrodes 11, 14 of the dielectric block 10. Under such construction, one end part of the resonator 16 is electrically shorted with the grounding electrode 11 of the dielectric block 10, and another end part thereof operates as a ¼ wavelength resonator opened in electricity. In such ¼ wavelength resonator on which its one end part is shorted with the grounding electrode and its another end part is opened electrically, a magnetic field is most strong on its short face and an electric field is most strong on its open face. An equivalent circuit of the filter based on the first embodiment is shown in FIG. 7, and a coupling between the input and output electrodes 12, 13 and its adjacent resonator 16 is a capacitive coupling, thus is represented as a capacitor.

In the filter having such construction by the first embodiment, an HF signal inputted to the input electrode 12 conveys energy to the resonator 16 through the capacitive coupling, and the energy is transferred between the respective resonators 16 through a coupling of a electromagnetic field. The energy transferred to the second resonator 16 is transmitted to the output electrode by means of the capacitive coupling, then operates as a filter.

At this time, a signal a user does not want is not transferred to the output electrode 13 since the signal flows through the grounding electrode 11 of the dielectric block 10.

Figure 8:
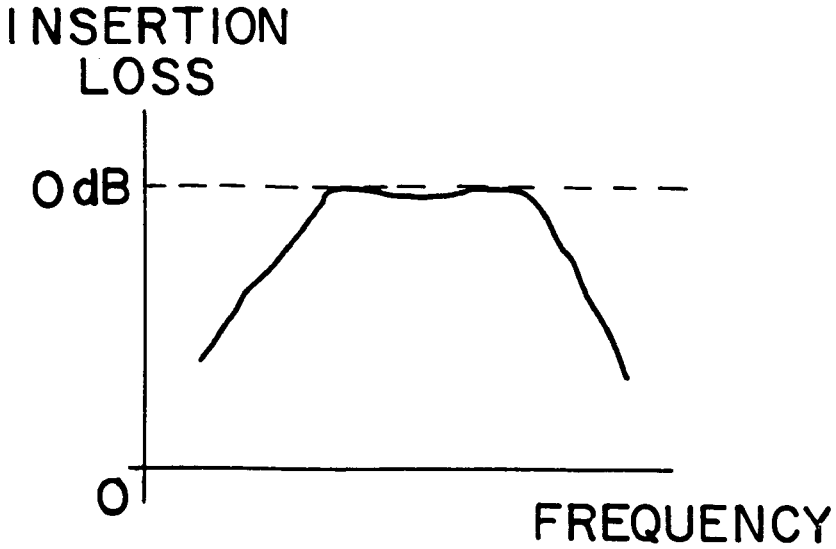
FIG. 8 offers a graph showing a characteristic for an insertion loss based on frequency of the HF filter shown in FIGS. 2 and 3.

In a characteristic of such filter as shown in FIG. 8, a frequency response characteristic is same at a stop band of frequency higher or lower than a pass band.

Figure 6:
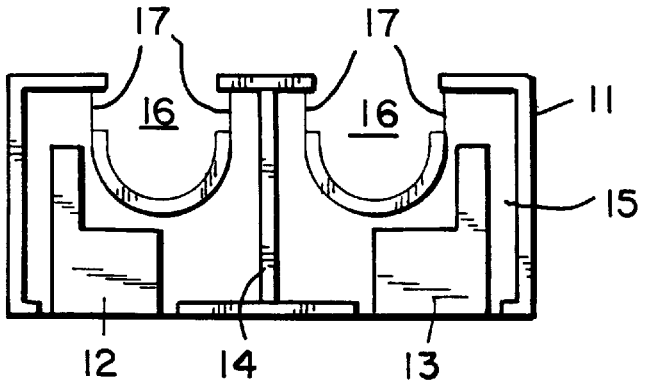
FIG. 6 gives a side view of a dielectric block on which grooves for use of a semicircular resonator shown in FIG. 3 are formed.

Meanwhile, in constructing a filter of such first embodiment, a bottom face of a groove for a formation of the resonator 16 can be formed as a semicircular shape as shown in FIG. 6.

Figure 9:
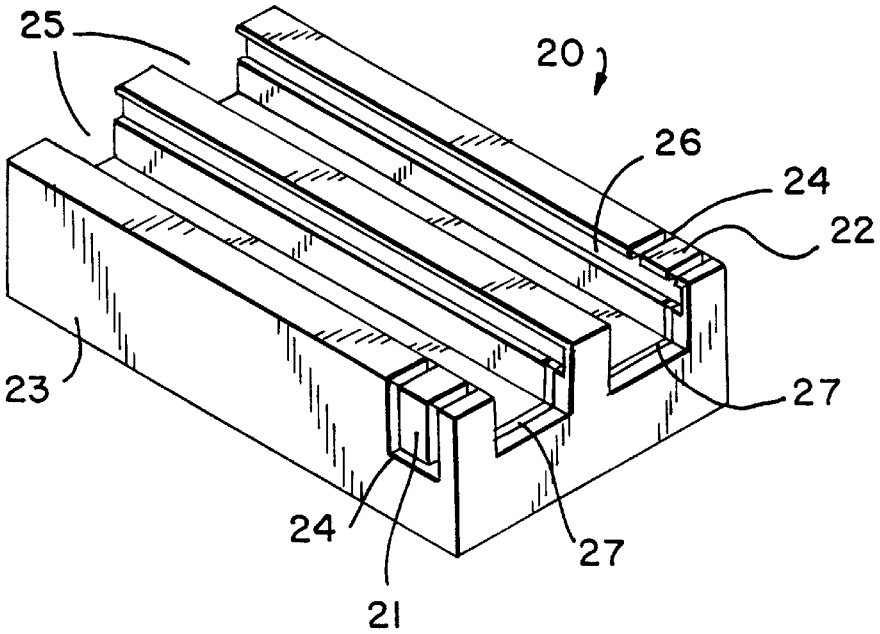
FIG. 9 illustrates a perspective view of an HF filter using resonators having a convex-concave structure in a second embodiment of the invention.

In accordance with a second embodiment of the present invention, an HF filter using resonators of the convex-concave structure shown in FIG. 9, equips a dielectric block 20 of a given shape on which input and output electrodes 21, 22 in charge of an input and an output of signals are formed confronted with each other on both sides of an upper side thereof. A constant outer face of the dielectric block 20 is coated with the conductive metal and operates as a grounding electrode 23. One nonplating part 24 formed between the input and output electrodes 21, 22 and the grounding electrode 23 prevents the input and output electrodes 21, 22 from being electrically shorted with the grounding electrode 23.

The dielectric block 20 is further constructed by grooves same as in the first inventive embodiment, the grooves being formed on an upper face of the dielectric block 20. Each lower portion of the grooves is coated with the conductive metal to thereby serve as a resonator 25. Further, another nonplating part 26 is formed between the grounding electrode 23 and the resonator 25 to prevent the resonator 25 from being electrically shorted with the grounding electrode 23. An additional nonplating part 27 is also formed on one side of the resonator 25 to prevent an open face of the resonator 25 from being electrically shorted with the grounding electrode 23. Whereby, a capacitive coupling is generated between the open face of the resonator 25 and the grounding electrode 23.

Figure 10:
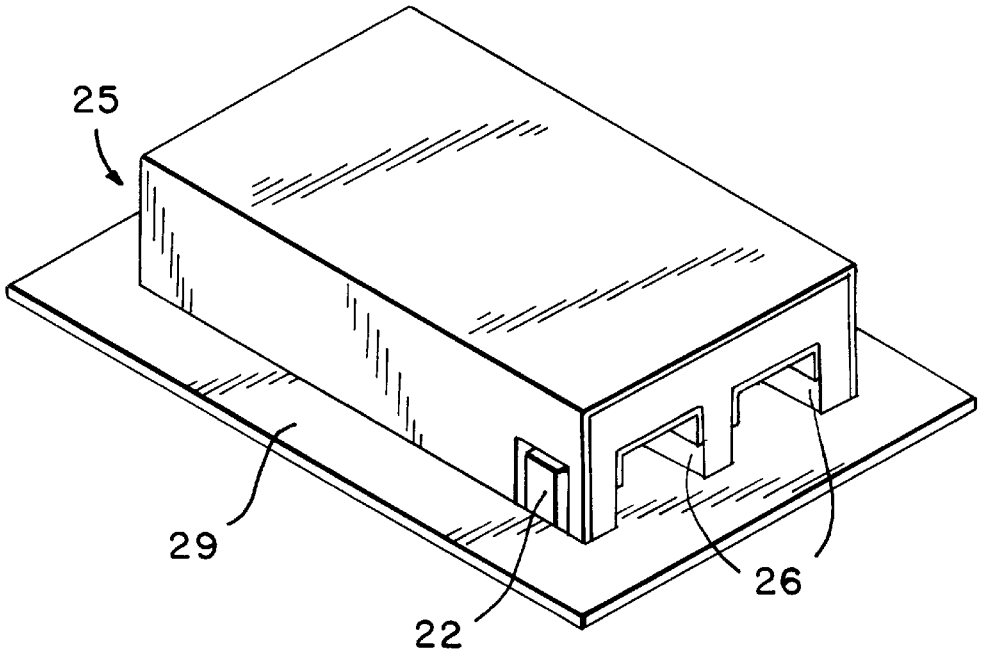
FIG. 10 provides a perspective view showing a state of the HF filter of FIG. 9 mounted on a printed circuit board.

In installing the filter with such construction of the second embodiment on the PCB, the upper face of the filter adheres to the PCB 29 as shown in FIG. 10. At this time, if a grounding electrode is formed on a portion of the PCB which has an installment of the filter and then the filter is mounted thereon, the resonator 25 is completely cut off from the electromagnetic wave of the outside.

Figure 11:
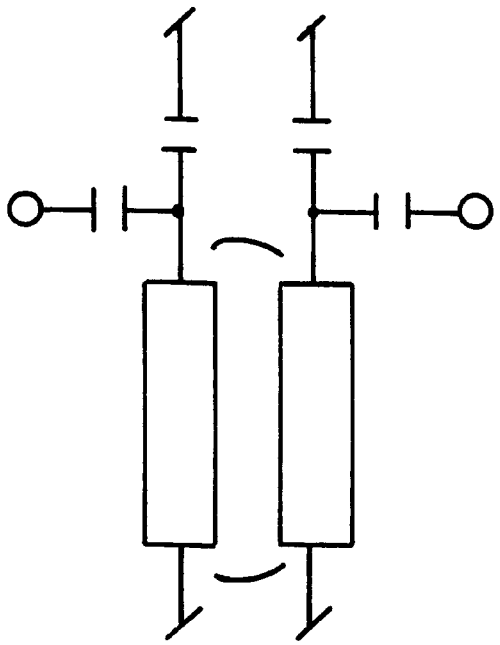
FIG. 11 is an equivalent circuit diagram of the HF filter shown in FIG. 9.
Figure 12:
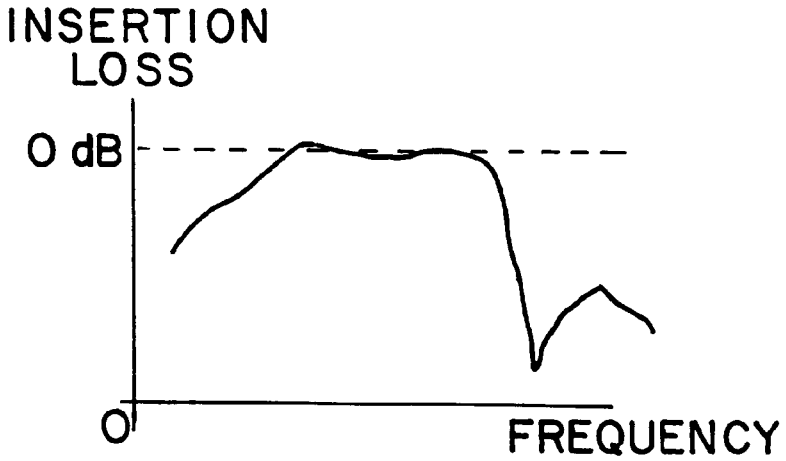
FIG. 12 depicts a graph for a characteristic of an insertion loss based on frequency of the HF filter shown in FIG. 9.

An equivalent circuit of the filter based on the second inventive embodiment is depicted in FIG. 11, and as shown in FIG. 11, a parallel capacitance is provided by the capacitive coupling between the open face of the resonator 25 and the grounding electrode 23. In such filter, a polar point having a value of '0' in a transfer characteristic is generated between the resonators, on frequency higher than the pass band, and as shown in FIG. 12, an attenuation characteristic can be improved on the frequency higher than the pass band. Here, a bottom face of the grooves for the resonator can be also formed not only as a square shape but also as various shapes such as a semicircular shape etc.

Figure 13:
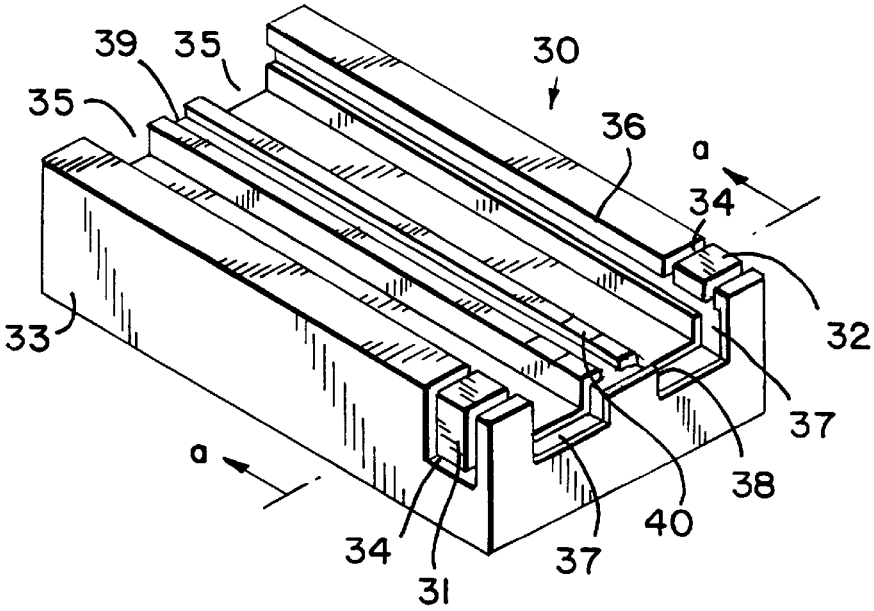
FIG. 13 is a perspective view of an HF filter using resonators having a convex-concave structure in accordance with a third embodiment of the present invention.
Figure 14:
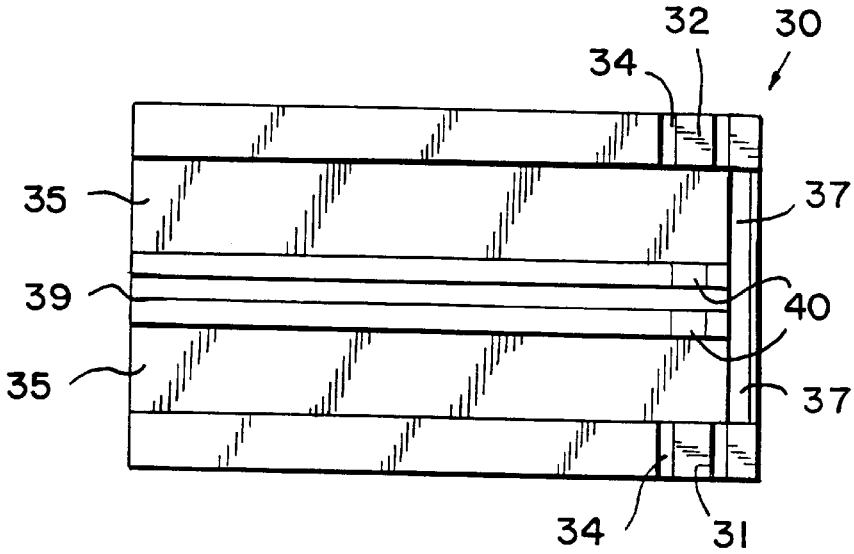
FIG. 14 provides a plan view of the HF filter shown in FIG. 13.
Figure 15:
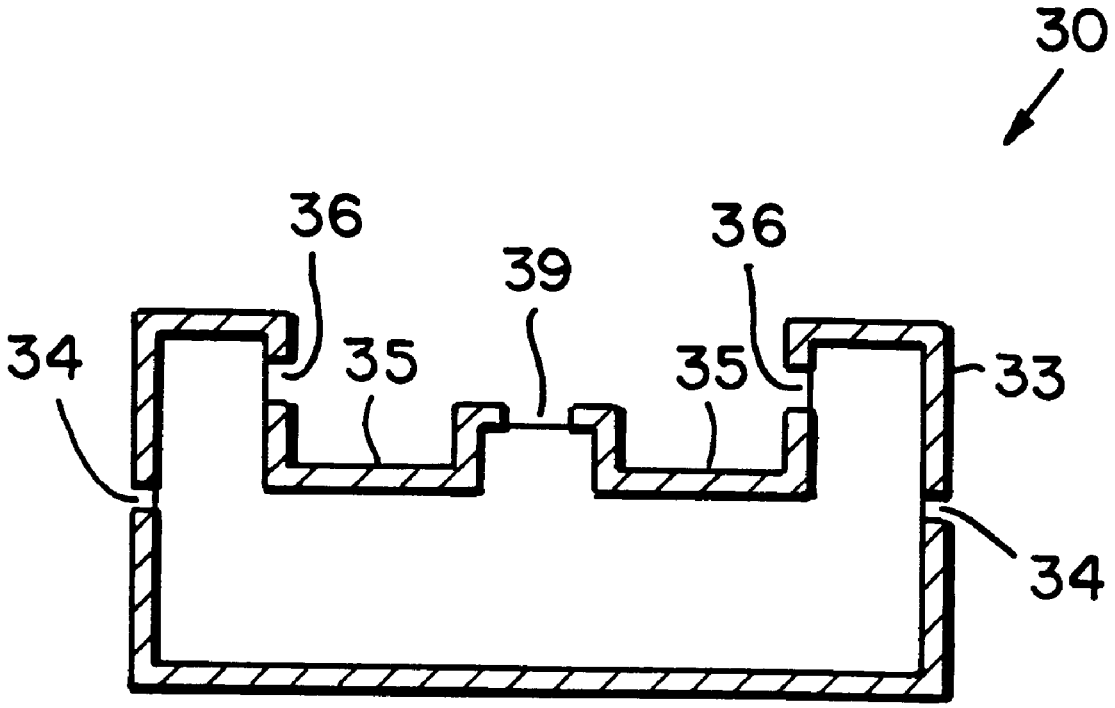
FIG. 15 shows a sectional view of a line a-a shown in FIG. 13.

In accordance with a third embodiment of the present invention, referring to FIGS. 13 through 15, an HF filter using resonators of the convex-concave structure equips a dielectric block 30 on which input and output electrodes 31, 32 of signals are formed confronted with each other on both sides of an upper face thereof. A constant outer face of the dielectric block 30 is covered with the conductive metal and operates as a grounding electrode 33. One nonplating part 34 formed among the input and output electrodes 31, 32 and the grounding electrode 33 prevents the input and output electrodes 31, 32 from being shorted with the grounding electrode 33.

The dielectric block 30 is also constructed by grooves same as in the second inventive embodiment, the grooves being formed on an upper face of the dielectric block 30. A given inner surface portion of the grooves is covered with the conductive metal to thereby operate as a resonator 35. Further, another nonplating part 36 is formed between the grounding electrode 33 and the resonator 35 to prevent the resonator 35 from being electrically shorted with the grounding electrode 33. An additional nonplating part 37 is also formed on one side of the resonator 35 to prevent an open face of the resonator 35 from being shorted with the grounding electrode 33.

A projection part 38 having a low height is formed between the grooves so as to form the resonators 35, the low height having a height enough to plate the inner surface of the resonator with the conductive material. The projection part 38 includes a further nonplating part 39 formed on an upper face thereof and, the nonplating part 39 is not plated and prevents the resonator 35 from being shorted with the grounding electrode 33.

A pattern 40 for a capacitive coupling is formed on the upper face of the projection part 38 so that the resonators can perform the capacitive coupling each other. Accordingly to such third inventive embodiment, the filter is improved in the attenuation characteristic for low frequency. At this time, the resonators can obtain a capacitive capacitance based on the capacitive coupling, between open faces of the capacitors each other.

Figure 16:
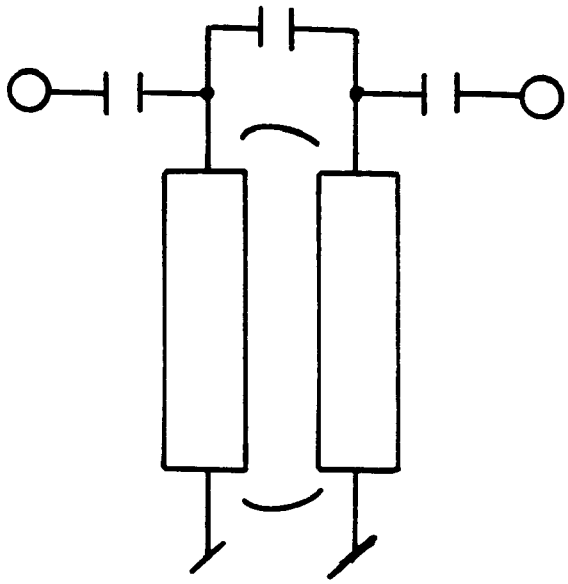
FIG. 16 represents an equivalent circuit diagram of the HF filter shown in FIG. 13.
Figure 17:
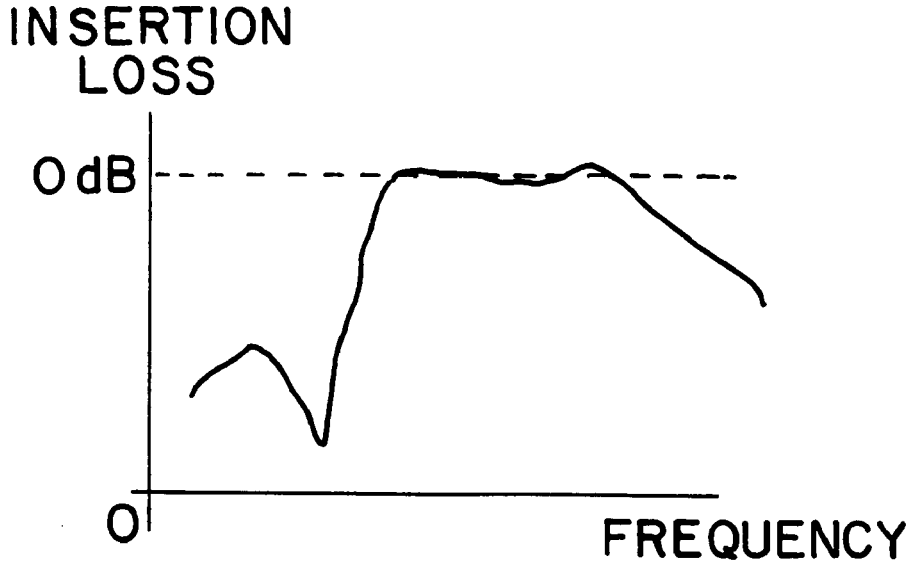
FIG. 17 is a graph for a characteristic of an insertion loss based on frequency of the HF filter shown in FIG. 13.

An equivalent circuit of the filter based on the third inventive embodiment is shown in FIG. 16, and as shown in FIG. 16, a capacitance of a serial connection exists between the resonators. In a characteristic of such filter, a polar point having a value of '0' in a transfer characteristic is generated on frequency lower than the pass band, by a capacitive and conductive coupling between the resonators. That is, as shown in FIG. 17, an attenuation characteristic of the filter based on the third embodiment can be improved on the frequency lower than the pass band.

In a case of installing such filter on the PCB, the upper face of the filter adheres to the PCB 29 as shown in FIG. 10. At this time, if an earthing face is formed on a portion of the PCB which has an installment of the filter and then the filter is mounted thereon, the resonators are completely cut off from the electromagnetic wave of the outside.

As afore-mentioned, in the present invention, a smallization of filters can be realized by forming grooves instead of holes in a dielectric block, in a formation of resonators, and particularly, a thickness of the filter can be reduced therein. Accordingly, it is available to mount the filter on the PCB on the subject of a high density and provide an effect in completely cutting off the electromagnetic wave of high frequency from the outside.

Furthermore, the invention is easy to embody serial or parallel capacitance for generating polarized frequency having a value of '0' in the transfer characteristic provided between the resonators at the stop band higher or lower than the pass band, to whereby improve an attenuation characteristic of the filter as another inventive effect.

In the present invention, an overall portion of the resonator can be also used in an error compensation for a permissible error of a manufacture process, to therefore simplify a manufacture process and curtail a manufacture cost. Such advantage may be an additional inventive effect.

Although the invention has been shown and described with respect to the preferred embodiments, it will be understood by those skilled in the art that various changes and modifications may be made without departing from the spirit and scope of the invention as defined in the following claims.

What is claimed is:

1. A high frequency (HF) filter using resonators of a convex-concave structure, comprising:

a dielectric block having a plurality of grooves formed in a longitudinal direction on an upper face thereof;

a grounding electrode formed by covering a first predetermined portion of an outer face of said dielectric block with conductive material;

a plurality of resonators formed by covering a bottom and a second predetermined portion of height of each side of each groove with conductive material, for resonating signals inputted from the outside, whereby remaining height of each side of each groove not covered with conductive material electrically isolates each resonator from the rounding electrode;

wherein the bottom is connected to the second predetermined portion;

an input electrode formed on a third predetermined portion of the dielectric block, for inputting the signals from the outside; and an output electrode formed on a fourth predetermined portion of the dielectric block, for outputting the signals, wherein the input electrode is electrically isolated from the output electrode.

2. A high frequency (HF) filter using resonators of a convex-concave structure, comprising:

a dielectric block having a plurality of grooves formed in a longitudinal direction on an upper face thereof;

a grounding electrode formed by covering a first predetermined portion of an outer face of said dielectric block with conductive material;

a plurality of resonators formed by covering a bottom and a second predetermined portion of height of each side of each groove with conductive material, for resonating signals inputted from the outside, whereby remaining height of each side of each groove not covered with conductive material electrically isolates each resonator from the grounding electrode, wherein the bottom is connected to the second predetermined portion;

projection means formed between the grooves of said dielectric block, said projection means having the same height as that of said resonator and having a third predetermined portion on an upper face thereof not covered with the conductive material, thus isolating said resonator from the grounding electrode;

an electrode formed by covering a fourth predetermined portion of the upper face of said projection means with the conductive material, for generating a capacitive coupling among the resonators;

an input electrode formed on a fifth predetermined portion on said dielectric block, for inputting the signals from the outside;

an output electrode formed on a sixth predetermined portion of the dielectric block, for outputting the signals;

wherein the input electrode is electrically isolated from the output electrode.

* * * * *

UNITED STATES PATENT AND TRADEMARK OFFICE

CERTIFICATE OF CORRECTION

PATENT NO. : 6,150,906
DATED : November 21, 2000
INVENTOR(S) : Chang Hwa Lee, Bon Hee Koo, Oh Gon Chun & Sang Seok Lee It is certified that error appears in the above-identified patent and that said Letters Patent is hereby corrected as shown below:

Title page,
Item [73] Assignee: please add the name of the joint assignee after "Electronics and Telecommunications Research Institute" as follows: "and Korea Telecom"

Signed and Sealed this

Ninth Day of October, 2001

*Attest:*

Nicholas P. Godici

*Attesting Officer*

NICHOLAS P. GODICI
*Acting Director of the United States Patent and Trademark Office*